US005176991A

United States Patent [19]

Jones et al.

[11] Patent Number: 5,176,991

[45] Date of Patent: Jan. 5, 1993

[54] PROCESS OF PREPARING FOR PHOTOGRAPHIC USE HIGH CHLORIDE TABULAR GRAIN EMULSION

[75] Inventors: Cynthia G. Jones, Bergen; Terrie L. Osborne-Perry, Rochester, both of N.Y.

[73] Assignee: Eastman Kodak Company, Rochester, N.Y.

[21] Appl. No.: 826,568

[22] Filed: Jan. 27, 1992

[51] Int. Cl.[5] ..... G03C 1/07; G03C 1/035

[52] U.S. Cl. ..... 430/569; 430/567; 430/614; 430/615

[58] Field of Search ..... 430/567, 569, 600, 614, 430/615

[56] References Cited

U.S. PATENT DOCUMENTS

| | | | |
|---|---|---|---|
| 4,400,463 | 8/1983 | Maskasky | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |

FOREIGN PATENT DOCUMENTS 3-116113 5/1991 Japan .

*Primary Examiner*—Charles L. Bowers, Jr.
*Assistant Examiner*—Mark F. Huff
*Attorney, Agent, or Firm*—Carl O. Thomas

[57] ABSTRACT

A process is disclosed of preparing a high chloride tabular grain emulsion for photographic use. An emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, is formed in the presence of at least one 2-hydroaminoazine or xanthinoid morphological stabilizer adsorbed to surfaces of the tabular grains. Chemical sensitization of the emulsion and protonation of the morphological stabilizer are performed at least in part concurrently. Termination of protonation of the morphological stabilizer retains a portion of the morphological stabilizer on the surfaces of the chemically sensitized tabular grains.

11 Claims, No Drawings

PROCESS OF PREPARING FOR PHOTOGRAPHIC USE HIGH CHLORIDE TABULAR GRAIN EMULSION

FIELD OF THE INVENTION

The invention is directed to a process of preparing for photographic use high chloride tabular grain emulsions.

DEFINITION OF TERMS

The term "high chloride" refers to silver halide grains or emulsions in which chloride accounts for at least 50 mole percent of total halide, based on silver.

The term "2-hydroaminoazine" refers to azines having a primary or secondary amino substituent that is bonded to the azine ring at a location next adjacent a ring nitrogen atom.

The term "hydroamino" is employed to designate amino groups containing at least one hydrogen substituent of the nitrogen atom—i.e., a primary or secondary amino substituent.

The term "azine" is employed to embrace six membered aromatic heterocylic rings containing carbon atoms and at least one nitrogen atom.

The term "xanthinoid" refers to substituted and unsubstituted forms of xanthine and 8-azaxanthine.

The term "morphological stabilization" refers to stabilizing the geometrical shape of a grain.

The term "tabular grain" is employed to designate grains having two parallel major faces lying in {111} crystallographic planes.

The terms "monolayer coverage" and "monomolecular layer" are employed in their art recognized usage to designate the calculated concentration of an adsorbed species that, if uniformly distributed on emulsion grain surfaces, would provide a layer of one molecule thickness.

The term "photographically useful compound" refers to compounds (i.e., addenda) that function during the storage, exposure and/or processing of photographic elements to enhance their image forming properties.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystographic planes. To produce successfully a high chloride tabular grain emulsion by twinning, conditions must be found that favor both the formation of twin planes and {111} crystal faces. Further, after the emulsion has been formed, tabular grain morphological stabilization is required to avoid reversion of the grains to their favored more stable form exhibiting {100} crystal faces. When high chloride tabular grains having {111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 (hereinafter designated Maskasky I) was the first to prepare in the presence of an adsorbed grain growth modifier a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. As grain growth modifiers, Tufano et al U.S. Pat. No. 4,804,621 and Houle et al U.S. Pat. No. 5,035,992 employed 4,6-di(hydroamino)-pyrimidines lacking a 5-position amino substituent (a 2-hydroaminoazine species); Japanese patent application 03/116,133, published May 17, 1991, employed adenine (a 2-hydroaminoazine species) in the pH range of from 4.5 to 8.5; Takada et al U.S. Pat. No. 4,783,398 employed heterocycles containing a divalent sulfur ring atom; Nishikawa et al U.S. Pat.

No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

RELATED PATENT APPLICATIONS

Maskasky U.S. Ser. No. 762,971, filed Sep. 20, 1991, commonly assigned, titled IMPROVED PROCESS FOR THE PREPARATION OF HIGH CHLORIDE TABULAR GRAIN EMULSIONS (II), (hereinafter designated Maskasky (() discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

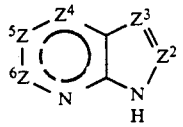

where $Z^2$ is $-C(R^2)=$ or $-N=$;

$Z^3$ is $-C(R^3)=$ or $-N=$;

$Z^4$ is $-C(R^4)=$ or $-N=$;

$Z^5$ is $-C(R^5)=$ or $-N=$;

$Z^6$ is $-C(R^6)=$ or $-N=$;

with the proviso that no more than one of $Z^4$, $Z^5$ and $Z^6$ is $-N=$;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 819,712, filed Jan. 13, 1992 (as a continuation-in-art of U.S. Ser. No. 763,382, now abandoned, filed Sep. 20, 1991) and commonly assigned, titled IMPROVED PROCESS FOR THE PREPARATION OF HIGH CHLORIDE TABULAR GRAIN EMULSIONS (IV), (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents.

Maskasky U.S. Ser. No. 820,168, filed Jan. 13, 1992 (as a continuation-in-art of U.S. Ser. No. 763,382, now abandoned, filed Sep. 20, 1991) and commonly assigned, titled IMPROVED PROCESS FOR THE PREPARATION OF HIGH CHLORIDE TABULAR GRAIN EMULSIONS (V), (hereinafter designated Maskasky V) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a grain growth modifier of the formula:

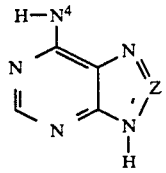

where $N^4$ is an amino moiety and

Z represents the atoms completing a 5 or 6 member ring.

Maskasky U.S. Ser. No. 763,030, filed Sep. 20, 1991, and commonly assigned, titled ULTRATHIN HIGH CHLORIDE TABULAR GRAIN EMULSIONS, (hereinafter designated Maskasky VI) discloses a high chloride tabular grain emulsion in which greater than 50 percent of the total grain projected area is accounted for by ultrathin tabular grains having a thickness of less than 360 {111} crystal lattice planes. A 2-hydroaminoazine morphological stabilizer of the type disclosed by Maskasky III and IV is adsorbed to the {111} major faces of the ultrathin tabular grains.

Maskasky and Chang U.S. Ser. No. 763,013, filed Sep. 20, 1991, commonly assigned, titled IMPROVED PROCESS FOR THE PREPARATION OF HIGH CHLORIDE TABULAR GRAIN EMULSIONS (III), (hereinafter designated Maskasky et al I) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

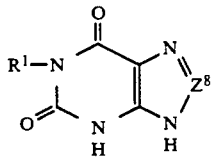

where $Z^8$ is $-C(R^8)=$ or $-N=$;

$R^8$ is H, $NH_2$ or $CH_3$; and $R^1$ is hydrogen or a hydrocarbon containing from 1 to 7 carbon atoms.

Maskasky U.S. Ser. No. 820,182, filed Jan. 13, 1992 (as a continuation-in-part of U.S. Ser. No. 763,030, filed Sep. 30, 1991) (hereinafter designated Maskasky VII), commonly assigned, discloses preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. The 2-hydroaminoazine is protonated and thereby released from the tabular grain surfaces into the dispersing medium. The released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the dispersing medium.

Maskasky and Chang U.S. Ser. No. 820,181, filed Jan. 13, 1992, commonly assigned (hereinafter referred to as Maskasky et al II), titled PROCESS FOR THE PREPARATION OF A GRAIN STABILIZED HIGH CHLORIDE TABULAR GRAIN PHOTOGRAPHIC EMULSION (II), discloses a process of preparing an emulsion for photographic use comprising (a) forming an emulsion as taught by Maskasky et al I, above, (b) reducing the pH of the dispersing medium below 4.0 to inactivate the xanthinoid as a morphological stabilizer, and (c) replacing the inactivated xanthinoid on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

SUMMARY OF THE INVENTION

In one aspect the invention is directed to a process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one morphological stabilizer adsorbed to surfaces of the tabular grains, and (2) chemically sensitizing the tabular grains.

The process is characterized by the steps of choosing the morphological stabilizer from among 2-hydroaminoazines and xanthinoids, initiating protonation of the morphological stabilizer adsorbed to the tabular grain surfaces, performing the step of chemical sensitization while protonation of the morphological stabilizer is occurring, and terminating protonation of the morphological stabilizer so that at least a portion of the morphological stabilizer is retained on the surfaces of the chemically sensitized tabular grains.

It has been discovered quite surprisingly that by partially removing the morphological stabilizer during chemical sensitization that greatly increased levels of photographic sensitivity can be achieved. The advantage realized is believed to result from making the grain surfaces more accessible to chemical sensitizers while at the same time retaining the desired tabular form of the grains.

DESCRIPTION OF PREFERRED EMBODIMENTS

The present invention is directed to a process of preparing for photographic use high chloride tabular grain emulsions having {111} major faces.

Preferred high chloride tabular grain emulsions prepared in the practice of the invention contain tabular grains accounting for at least 50 percent of total grain projected that contain at least 50 mole percent chloride, based on total silver. The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on total silver while the iodide content is preferably less than 2 mole percent and optimally less than 1 mole percent. When more than one halide ion is present in the tabular grains, the halides can be uniformly or nonuniformly distributed.

The photographic advantages of tabular grains are a function of their tabularity. Preferred emulsions in which the tabular grains exhibit a high mean tabularity--that is, they satisfy the mean tabularity relationship:

$$\frac{ECD}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, ECD/t>8. When high aspect ratio tabular grains exhibit a thickness of 0.3 μm or less, the grains also exhibit high tabularity. When the thickness of the tabular grains is 0.2 μm or less high tabularities can be realized at intermediate aspect ratios of 5 or more.

Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less.

Tufano et al, cited above and here incorporated by reference, discloses high chloride tabular grain emulsions satisfying the requirements of this invention having thicknesses ranging down to 0.062 μm (388 {111} crystal lattice planes). In Maskasky VI (U.S. Ser. No. 763,030, filed Sep. 20, 1991, cited above), ultrathin tabular grain emulsions are disclosed in which high chloride tabular grains have mean thicknesses of less than 360 {111} lattice planes. Using a silver chloride {111} lattice spacing of 1.6 Å as a reference, the following correlation of grain thicknesses in μm applies:

360 lattices planes<0.06 μm
300 lattices planes<0.05 μm
180 lattices planes<0.03 μm
120 lattices planes<0.02 μm Ultrathin high chloride tabular grain emulsions in which mean grain thicknesses range down to 120 lattice planes can be prepared.

It is specifically contemplated to apply the practice of the present invention to thin (t<0.2 μm) and ultrathin (t<360 {111} lattice planes), since the morphological instability of the tabular grains increases as their mean thickness decreases.

To maximize the advantages of having high chloride tabular grains present in the emulsions it is preferred that the high chloride tabular grains account for greater than 70 percent and, optimally, greater than 90 percent of total grain projected area. With care in preparation or when accompanied by conventional grain separation techniques the projected area accounted for by high chloride tabular grains can approximate 100 percent of total grain projected area for all practical purposes.

Grains other than the high chloride tabular grains when present in the emulsion are generally coprecipitated grains of the same halide composition. It is recognized that for a variety of applications the blending of emulsions is undertaken to achieve specific photographic objectives. Other emulsions can be blended before or after chemical sensitization in accordance with this invention, but are preferably blended after chemical sensitization to allow each emulsion component being blended to be separately optimally sensitized.

The high chloride content of the tabular grains renders their {111} major faces unstable, since silver chloride strongly favors {100} crystal faces. Unfortunately, the tabular shape of the grains is destroyed when {100} crystal faces emerge. The reason is that tabular grains with {111} crystal faces contain parallel twin planes but grains with parallel twin planes and {100} faces cannot exist in a tabular form.

To allow the high chloride tabular grains to be formed a morphological stabilizer is employed that adsorbs to the {111} faces of the tabular grains. This invention can be practiced with morphological stabilizers that can be removed from the grain surfaces by protonation. Preferred morphological stabilizers are 2-hydroaminoazines and xanthinoid compounds (defined above).

The essential structural components of the 2-hydroaminoazine can be visualized from the following formula:

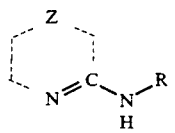

(I)

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

The structural features in formula I that morphologically stabilize the tabular grain {111} crystal faces are (1) the spatial relationship of the two nitrogen atoms shown, (2) the aromatic ring stabilization of the left nitrogen atom, and (3) the hydrogen attached to the right nitrogen atom. It is believed that the two nitrogen atoms interact with the {111} crystal face to facilitate adsorption. The atoms forming R and Z can, but need not, be chosen to actively influence adsorption and morphological stabilization. Various forms of Z and R are illustrated by various species of 2-hydroaminoazines described below.

In one illustrative form the 2-hydroaminoazine can satisfy the formula:

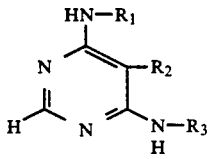

(II)

wherein $R_1$, $R_2$ and $R_3$, which may be the same or different, are H or alkyl of 1 to 5 carbon atoms; $R_2$ and $R_3$ when taken together can be $—CR_4=CR_5—$ or $—CR_4=N—$, wherein $R_4$ and $R_5$, which may be the same or different are H or alkyl of 1 to 5 carbon atoms, with the proviso that when $R_2$ and $R_3$ taken together form the $—CR_4=N—$ linkage, $—CR_4=$ must be joined to the ring at the $R_2$ bonding position.

In another illustrative form the 2-hydroaminoazine can satisfy the following formula:

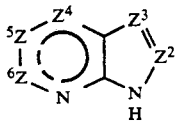

(III)

where $Z^2$ is $—C(R^2)=$ or $—N=$;

$Z^3$ is $—C(R^3)=$ or $—N=$;

$Z^4$ is $—C(R^4)=$ or $—N=$;

$Z^5$ is $—C(R^5)=$ or $—N=$;

$Z^6$ is $—C(R^6)=$ or $—N=$;

with the proviso that no more than one of $Z^4$, $Z^5$ and $Z^6$ is $—N=$;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

In an additional illustrative form the 2-hydroaminoazine can take the form of a triamino-pyrimidine grain growth modifier containing mutually independent 4, 5 and 6 ring position amino substituents with the 4 and 6 ring position substituents being hydroamino substituents. The 2-hydroaminoazine in this form can satisfy the formula:

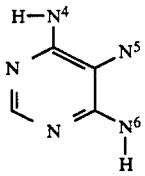

(IV)

where $N^4$, $N^5$ and $N^6$ are independent amino moieties. In a specifically preferred form the 2-hydroaminoazines satisfying formula IV satisfy the following formula:

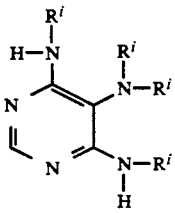

(V)

where $R^i$ is independently in each occurrence hydrogen or alkyl of from 1 to 7 carbon atoms.

In still another illustrative form the 2-hydroaminoazine can satisfy the formula:

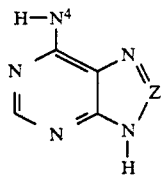

(VI)

where $N^4$ is an amino moiety and

Z represents the atoms completing a 5 or 6 member ring.

Preferred xanthinoid morphological stabilizers are those satisfying the formula:

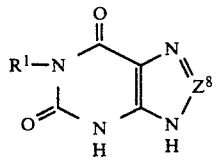

(VII)

where $Z^8$ is $—C(R^8)=$ or $—N=$;

$R^8$ is H, $NH_2$ or $CH_3$; and $R^1$ is hydrogen or a hydrocarbon of from 1 to 7 carbon atoms.

When the xanthinoid is chosen to have a xanthine nucleus, the structure of the grain growth modifier is preferably as shown in the following formula:

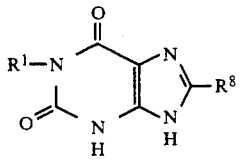

(VIII)

When the xanthinoid is chosen to have an 8-azaxanthine nucleus, the structure of the grain growth modifier is preferably as shown in the following formula:

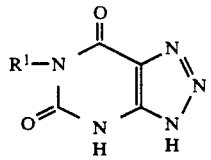

(IX)

No substituents of any type are required on the ring structures of formulae VII to IX. Thus, each of $R^1$ and $R^8$ can in each occurrence be hydrogen. $R^8$ can in addition include a sterically compact hydrocarbon substituent, such as $CH_3$ or $NH_2$. $R^1$ can additionally include a hydrocarbon substituent of from 1 to 7 carbon atoms. Each hydrocarbon moiety is preferably an alkyl group—e.g., methyl, ethyl, n-propyl, i-propyl, n-butyl, i-butyl, t-butyl, etc. , although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

An aqueous gelatino-peptizer dispersing medium is present during precipitation. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky II or King et al, both cited above and here incorporated by reference.

During the precipitation of photographic silver halide emulsions there is always a slight stoichiometric excess of halide ion present. This avoids the possibility of excess silver ion being reduced to metallic silver and resulting in photographic fog. It is a significant advantage of this invention that the stoichiometric excess of chloride ion in the dispersing medium can be maintained at a chloride ion concentration of less than 0.5M while still obtaining a high aspect ratio tabular grain emulsion. It is generally preferred that the chloride ion concentration in the dispersing medium be less than 0.2M and, optimally, equal to or less than 0.1M.

The advantages of limiting the stoichiometric excess of chloride ion present in the reaction vessel during precipitation include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent. It has also been observed that reduction in the chloride ion excess contributes to obtaining thinner tabular grains.

The morphological stabilizers of the invention are effective over a wide range of pH levels conventionally employed during the precipitation of silver halide emulsions. It is contemplated to maintain the dispersing medium within conventional pH ranges for silver halide precipitation, typically from 3 to 9, while the tabular grains are being formed, with a pH range of 4.5 to 8 being in most instances preferred. Within these pH ranges optimum performance of individual morphological stabilizers can be observed as a function of their specific structure. The morphological stabilizers are effective during precipitation when the pH is sufficiently high that they remain unprotonated. A strong mineral acid, such as nitric acid or sulfuric acid, or a strong mineral base, such as an alkali hydroxide, can be employed to adjust pH within a selected range. When a basic pH is to be maintained, it is preferred not to employ ammonium hydroxide, since it has the unwanted effect of acting as a ripening agent and is known to thicken tabular grains. However, to the extent that thickening of the tabular grains does not exceed the 0.3 μm thickness limit, ammonium hydroxide or other conventional ripening agents (e.g., thioether or thiocyanate ripening agents) can be present within the dispersing medium.

Any convenient conventional approach of monitoring and maintaining replicable pH profiles during repeated precipitations can be employed (e.g., refer *to Research Disclosure Item* 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxymethyl)aminomethane.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major {111} crystal faces of the tabular grains, since this has the effect of thickening the grains. The morphological stabilizers employed in the practice of this invention are effective during precipitation to produce an emulsion satisfying both the tabular grain thickness and projected area parameters noted above.

It is believed that the effectiveness of the morphological stabilizers to induce twinning during precipitation results from the spacing of the required nitrogen atoms in the fused five and six membered heterocyclic rings and their ability to form silver salts. This can be better appreciated by reference to the following structure:

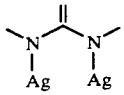

(X)

C. Cagnon et al, *Inorganic Chem.*, 16:2469 (1977) reports a silver salt satisfying the nitrogen atom and silver pairing arrangement of formula X and provides bond lengths establishing the spacing between the adjacent silver atoms of the formula. Based on the crystal structure of silver chloride revealed by X-ray diffraction it is believed that the resulting spacing between the silver ions is much closer to the nearest permissible spacing of silver ions in next adjacent {111} silver ion crystal lattice planes separated by a twin plane than the nearest spacing of silver ions in next adjacent {111} silver ion crystal lattice planes not separated by a twin plane. Thus, when one of the silver ions shown above is positioned during precipitation in a {111} silver ion crystal lattice plane, assuming a sterically compatible location (e.g., an edge, pit or coign position) is occupied, the remaining of the silver ions shown above favors a position in the next {111} silver ion crystal lattice plane that is permitted only if twinning occurs. The remaining silver atom of the growth modifier (together with other similarly situated growth modifier silver ions) acts to seed (enhance the probability of) a twin plane being formed and growing across the {111} crystal lattice face, thereby providing a permanent crystal feature essential for tabular grain formation.

It is, of course, also important that the ring substituents next adjacent the ring nitrogen shown in formula X be chosen to minimize any steric hindrance that would prevent the silver ions from having ready access to the {111} crystal lattice planes as they are being formed. A further consideration is to avoid substituents to the ring positions next adjacent the ring nitrogen shown that are strongly electron withdrawing, since this creates competition between the silver ions and the adjacent ring position for the $\pi$ electrons of the nitrogen atoms. For example, when Z, $Z^2$ or $Z^8$ is primary amino (—$NH_2$), aza (—N=) or methine (—CH=), an optimum structure for silver ion placement in the crystal lattice exists. When the amino or methine moiety is substituted with a compact substituent, as described above, twin plane formation is readily realized. Ring positions separated from the ring nitrogen by an intervening ring position are not viewed as significantly influencing twin plane formation.

In addition to selecting substituents for their role in twin plane formation, they must also be selected for their compatibility with promoting the formation of {111} crystal faces during precipitation. By selecting substituents as described above the emergence of {100}, {110} and higher index crystal plane faces of the types described by Maskasky U.S. Pat. Nos. 4,643,966, 4,680,254, 4,680,255, 4,680,256 and 4,724,200, is avoided.

Once a stable multiply twinned grain population has been formed within the dispersing medium, the primary, if not exclusive, function the morphological stabilizer is called upon to perform is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of morphological stabilizer required to control thickness growth of the tabular grain population is a function of the total grain surface area. By adsorption onto the {111} surfaces of the tabular grains the morphological stabilizer restrains precipitation onto the grain faces and shifts further growth of the tabular grains to their edges.

The benefits of this invention can be realized using any amount of morphological stabilizer that is effective to retard thickness growth of the tabular grains. It is generally contemplated to have present in the emulsion during tabular grain growth sufficient morphological stabilizer to provide a monomolecular adsorbed layer over at least 25 percent, preferably at least 50 percent, of the total {111} grain surface area of the emulsion grains. Higher amounts of adsorbed morphological stabilizer are, of course, feasible. Adsorbed morphological stabilizer coverages of 80 percent of monomolecular layer coverage or even 100 percent are contemplated. In terms of tabular grain thickness control there is no significant advantage to be gained by increasing morphological stabilizer coverages above these levels.

Prior to introducing silver salt into the dispersing medium at the outset of the precipitation process, no grains are present in the dispersing medium, and the initial morphological stabilizer concentrations in the dispersing medium are therefore more than adequate to provide the monomolecular coverage levels noted above as grains are initially formed. As tabular grain growth progresses it is a simple matter to add morphological stabilizer, as needed, to maintain monomolecular coverages at desired levels, based on knowledge of amount of silver ion added and the geometrical forms of the grains being grown. If, as noted above, morphological stabilizer has been initially added in excess of its solubility limit, undissolved morphological stabilizer can enter solution as dissolved morphological stabilizer is depleted from the dispersing medium by adsorption on grain surfaces. This can reduce or even eliminate any need to add morphological stabilizer to the reaction vessel as grain growth progresses.

In *Research Disclosure*, Vol. 308, Dec. 1989, Item 308119, the disclosure of which is here incorporated by reference, the following topics reflect the most commonly employed sequence of steps in preparing photographic emulsions for photographic use:

I. Emulsion preparation and types;
II. Emulsion washing;
III. Chemical sensitization;
IV. Spectral sensitization and desensitization.

This sequence of steps can be followed in the practice of this invention. Step I has been described in detail above. Steps II and IV can be performed in any convenient conventional manner. Step II is preferred, but can be eliminated by proceeding directly from emulsion preparation to chemical sensitization. The emulsions of the invention need not be spectrally sensitized. Hence Step IV can be eliminated, if desired. In still another alternative spectral sensitizing dye can be added to the emulsion immediately before or during the chemical sensitization step. Except for the protonation and deprotonation steps specifically discussed below, chemical and/or spectral sensitization is preferably undertaken as disclosed by Kofron et al U.S. Pat. No. 4,439,520, the disclosure of which is here incorporated by reference.

As is generally appreciated by those skilled in the art, chemical sensitizations are generally categorized as sulfur, gold or reduction sensitizations in which active sensitizing agents containing sulfur, gold or reducing agents capable of interacting with the grain surface are introduced. Sulfur chemical sensitization has direct analogues in selenium and tellurium chemical sensitizations. Although the term "middle chalcogen sensitization" has been employed on occasion to designate generically this class of chemical sensitization, those skilled in the art usually refer to sulfur sensitization without intending to exclude selenium and tellurium sensitizations. Similarly, gold chemical sensitizations have analogues in other Group VIII noble metal sensitizations, with the latter generally regarded as belonging in the same general category, occasionally referred to as noble metal sensitization. Again, those skilled in the art usually do not intend to exclude other noble metal sensitizations when referring nominally to gold sensitization. Combinations of two of the sulfur, gold and reduction categories of chemical sensitizations are common, with sulfur and gold chemical sensitizations being most common in high sensitivity negative-working photographic emulsions.

Although sulfur, gold and reduction chemical sensitizations differ in the choice of the sensitizing agent, the general technique of chemical sensitization in each instance is similar. The emulsion is typically held at a temperature in the range of from 30° to 80° C. for a period of time to allow the necessary chemical reaction to occur on the grain surfaces. The optimum time and temperature for each emulsion is dependent on its halide content, grain morphology (i.e., whether the grains are regular or irregular and what crystal faces form the surfaces of the grains), and the grain size-frequency profile. For emulsions intended to be replicated in large quantities (i.e., intended to be incorporated in commercial products) different chemical sensitizations are undertaken using small samples of the emulsion to arrive empirically at an optimum or near optimum sensitization. Once a substantially optimum sensitization has been obtained, the same time and temperature profile is employed for the sensitization of all subsequent replications of the emulsion.

It has been discovered that by initiating protonation of a 2-hydroaminoazine or xanthinoid morphological stabilizer adsorbed to the {111} grain surfaces of a high chloride tabular grain emulsion and performing the step of chemical sensitization while protonation of the morphological stabilizer is occurring a higher level of photographic sensitivity (speed) can be realized. Further, by terminating protonation of the morphological stabilizer so that at least a portion of the morphological stabilizer is retained on the surfaces of the chemically sensitized tabular grains the advantage realized by enhanced chemical sensitization is not offset by degradation of grain tabularity.

Protonation of both the 2-hydroaminoazine and xanthinoid morphological stabilizers results in their release (desorption) from the {111} grain surfaces. Protonation can be initiated merely by lowering the pH of the emulsion. pH is preferably lowered using the same mineral acids (e.g., sulfuric acid or nitric acid) conventionally used to adjust pH during emulsion precipitation.

The optimum pH to initiate protonation differs with the selection of the morphological stabilizer. It is contemplated to lower the pH of the emulsion dispersing medium to less than 3.0 to protonate the xanthinoid compounds. While different xanthinoid compounds are protonated at a slightly different pH, protonation of preferred xanthinoid compounds can be achieved within the pH range of from 2.9 to 0.5, most preferably from 2.5 to 1.0. While each 2-hydroaminoazine is also protonated at a slightly different pH, protonation of preferred 2-hydroaminoazine compounds can be effected within the pH range of from 5.0 to 1.0, most preferably from 4.0 to 1.5. Protonation in these pH ranges is highly advantageous, since it allows protonation to be achieved without subjecting the emulsion to extremely acid conditions that could degrade other emulsion components.

To terminate protonation of the morphological stabilizer the pH of the emulsion is raised to the levels noted above for emulsion preparation. The pH should be raised above 4.5 in most instances, and the pH of the emulsion is preferably above 5. The pH of the emulsion can be raised by using any base conventionally used to raise emulsion pH—e.g., sodium or potassium hydroxide. The pH is preferably raised immediately following the completion of chemical sensitization. It is, however, possible to raise pH while the emulsion is still being held at the elevated temperature employed for chemical sensitization. For example, pH can be increased after 50 or 70 percent of the holding period, if desired. Raising pH before completion of the holding period, slows the rate of subsequent sensitization.

Terminating protonation of the morphological stabilizer in the latter stages of or immediately following chemical sensitization has the beneficial effect of retaining the unprotonated portion of the morphological stabilizer on the {111} tabular grain surfaces so that the tabularity of the grains can be protected.

It is possible to rely on the residual morphological stabilizer adsorbed to the grain surfaces to protect grain tabularity during subsequent handling of the emulsions leading to the formation of a coated emulsion layer in the fabrication of a photographic product. Upon raising pH the protonated forms of the 2-hydroaminoazines and xanthinoids are, at least in part, deprotonated and, hence, are again available to readsorb to exposed surfaces of the tabular grains.

It is specifically contemplated to supplement the residual 2-hydroaminoazine or xanthinoid adsorbed to the tabular grain surfaces by incorporating in the emulsion one or more photographically useful compounds containing at least one divalent sulfur atom. Spectral sensitizing dyes, desensitizers, hole trapping dyes, antifoggants, stabilizers and development modifiers are illustrations of different classes of photographically useful compounds that can be selected to contain one or more divalent sulfur atom containing moieties. A wide variety of photographically useful compounds containing one or more divalent sulfur atoms is disclosed in *Research Disclosure,* Item 308119, cited above and here incorporated by reference.

The following are illustrative of varied divalent sulfur atom moieties commonly found in photographically useful compounds:

| | |
|---|---|
| M-1 | —S—H<br>mercapto |
| M-2 | —S—$R^a$ |

where $R^a$ is any convenient hydrocarbon or substituted hydrocarbon—e.g., when $R^a$ an alkyl group the resulting moiety is an alkylthia moiety (methylthia, ethylthia, propylthia, etc.) and when $R^a$ is an aromatic group the resulting moiety is an arylthia moiety (phenylthia, naphthylthia, etc.) or $R^a$ can be a heterocyclic nucleus, such as any of the various heterocyclic nuclei found in cyanine dyes.

| | |
|---|---|
| M-3 | —S—S—$R^a$<br>where $R^a$ is as described above |
| M-4 | 1,4-thiazine |
| M-5 | thiazoline |
| M-6 | thiazole |
| M-7 | thiophene |
| M-8 | 3-thia-1,4-diazole |
| M-9 | benzothiazole |
| M-10 | naphtho[2,1-d]thiazole |
| M-11 | naphtho[1,2-d]thiazole |
| M-12 | naphtho[2,3-b]thiazole |
| M-13 | thiazolo[4,5-b]quinoline |
| M-14 | 4,5-dihydrobenzothiazole |
| M-15 | 4,5,6,7-tetrahydrobenzothiazole |
| M-16 | 4,5-dihydronaptho[1,2-d]thiazole |
| M-17 | phenanthrothiazole |
| M-18 | acenaphthothiazole |
| M-19 | isorhodanine |
| M-20 | rhodanine |
| M-21 | thiazolidin-2,4-dione |
| M-22 | thiazolidin-2,4-dithione |
| M-23 | 2-dicyanomethylenethiazolidin-4-one |
| M-24 | 2-diphenylamino-1,3-thiazolin-4-one |
| M-25 | benzothiophen-3-one |

The moieties M-1 to M-8 as well as some of the subsequent moieties, such as M-9 and M-20, are commonly encountered in various photographically useful compounds such as antifoggants, stabilizers and development modifiers. The moieties M-5 to M-18 are common heterocyclic nuclei in polymethine dyes, particularly cyanine and merocyanine sensitizing dyes. The moieties M-19 to M-25 are common acidic nuclei in merocyanine dyes. The heterocyclic moieties M-4 to M-25 are named as rings, since the site of ring attachment can be at any ring carbon atom. and ring, substituents, if any, can take any convenient conventional form, such as any of the various forms described above in connection with $R^a$.

The morphological stabilizers relied upon for protection of grain tabularity should be present in the emulsion at each stage of the process in an amount sufficient to provide at least 20 percent of monomolecular coverage on the grain surfaces, preferably from 50 to 100 percent of monomolecular coverage, assuming total adsorption. Introducing greater that 100 percent of monomolecular coverage is inefficient, but can be tolerated to varying degrees, depending upon the specific morphological stabilizer or combination of morphological stabilizers present. If higher concentrations of the divalent sulfur atom containing compound are desired to satisfy its photographic utility unrelated to morphological grain stabilization, further addition of the compound can be undertaken at any convenient subsequent point in preparation of the photographic element.

Apart from the features of the invention that have been specifically described, the emulsions and their preparation can take any convenient conventional form. *Research Disclosure,* Vol. 308, Dec. 1989, Item 308119, is here incorporated by reference for its disclosure of conventional emulsion features, and attention is specifically directed to Sections IV, VI and XXI.

Examples

The invention can be better appreciated by reference to the following specific embodiments.

EXAMPLE 1

An emulsion was prepared in the following manner:

A stirred reaction vessel containing 3L of a solution which was 2% in bone gelatin, 3.5 mM in adenine, and 0.070M in NaCl at 75° C. was provided. To this solution at 75° C. was added 4M $AgNO_3$ solution at 1 mL/min for 4 min and then the rate of solution was linearly accelerated over an additional period of 60 min (20X from start to finish) and finally held constant at 20 mL/min until 750 mL of solution was consumed. When the pAg reached 6.60 (0.03M in chloride), a 4M NaCl solution was added at a rate needed to maintain this pAg. The pH was allowed to range between 5.0 and 6.0 during precipitation. A total of 3.0 moles of AgCl were precipitated. The emulsion was cooled to 40° C. and washed by the coagulation method of U.S. Pat. No. 2,614,929 of Yutzy and Russell.

The resultant high aspect ratio tabular grain AgCl emulsion was judged to have a grain population similar to that of an emulsion identically prepared (except that pH ranged from 6.2 at the outset to 5.9 at the conclusion of precipitation) having an average tabular grain diameter of 1.3 μm, an average tabular grain thickness of 0.078 μm, and an average tabular grain aspect ratio of 17:1, with 85% of the grains being tabular based on total grain projected area.

The emulsion was melted at 70° C. The pH of the emulsion was lowered to 4.0 by the addition of 4.5 mole percent nitric acid. A spectral sensitizing dye combination in the amount of 0.75 millimole/Ag mole of was added, followed, in order, by 10 milligrams/Ag mole dicarboxymethyl-dimethyl thiourea, 800 milligrams/Ag mole sodium thiocyanate, and 5 milligrams/Ag mole of aurous bis(1,4,5-trimethyl-1,2,4-triazolium-3-thiolate) tetrafluoroborate. The spectral sensitizing dye combination with a 3:1 molar ratio of anhydro-5-chloro-9-ethyl-5'-phenyl-3'-(3-sulfobutyl)-3-(3-sulfopropyl)oxacarbocyanine hydroxide, triethyl amine salt (Dye A) and anhydro-11-ethyl-1,1'-bis(3-sulfopropyl)naphth-[1,2-d]oxazolocarbocyanine hydroxide, sodium salt.

The emulsion was held at 70° C. for 2 minutes. The emulsion was then cooled to 40° C. Two hundred fifty milligrams/Ag mole of 5-methyl-s-triazole-[2-3-a]-pyrimidine-7-ol were added, followed by 4.0 mole percent sodium hydroxide, thereby restoring the pH to its original 5 to 6 level, to prevent any further deactivation of the adenine.

CONTROL 1

A second emulsion was prepared and chemically sensitized as described in Example 1, except that steps of introducing nitric acid to lower the pH to 4.0 and introducing sodium hydroxide to restore the pH to was omitted. In other words, the pH of the emulsion remained throughout in the 5 to 6 range.

COATING AND CHARACTERIZATION

Samples of the Example 1 and Control 1 emulsions were identically coated, exposed and processed. Both coatings were given a 0.02 second exposure on an Eastman 1B TM sensitometer and processed for 6 minutes in a hydroquinone-Elon TM (N-methylaminophenol hemisulfate) developer. The coated element containing the Example 1 emulsion exhibited a 0.56 log E higher speed.

Comparison of unexposed samples revealed a 17 percent higher light absorption at the absorption wavelength of aggregated spectral sensitizing dye by the coating of the Example 1 emulsion as compared to than that of the Control 1 emulsion.

These observations demonstrate a dramatic increase in photographic sensitivity attributable to maintaining a lowered pH during chemical sensitization. It is believed that the lowered pH resulted in protonation of the adenine on the surface of the silver chloride grains occurring during chemical sensitization, allowing better access of sensitizers to the grains surfaces. Completing chemical sensitization before protonation was complete and terminating the protonation reaction by increasing pH was responsible for retaining the desired tabular form of the grains.

The invention has been described in detail with particular reference to preferred embodiments thereof, but it will be understood that variations and modifications can be effected within the spirit and scope of the invention.

What is claimed is:

1. A process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one morphological stabilizer adsorbed to surfaces of the tabular grains, and (2) chemically sensitizing the tabular grains,

CHARACTERIZED BY THE STEPS OF forming the emulsion in the presence of a stoichiometric excess of chloride ion having a chloride ion concentration of less than 0.5M, the morphological stabilizer being in an amount sufficient to provide a monomolecular layer absorbed to at least 25 percent of the surface area of the emulsion grains, choosing the morphological stabilizer from among 2-hydroaminoazines and xanthnoids, initiating protonation of the morphological stabilizer adsorbed to the tabular grain surfaces, performing the step of chemical sensitization while protonation of the morphological stabilizer is occurring, and terminating protonation of the morphological stabilizer so that at least a portion of the morphological stabilizer is retained on the surfaces of the chemically sensitized tabular grains.

2. A process according to claim 1 further characterized in that the 2-hydroaminoazine morphological stabilizer satisfies the formula:

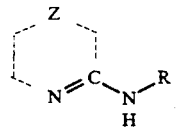

where

Z represents the atoms completing a 6 member aromatic heterocyclic ring the ring atoms of which are either carbon or nitrogen and R represents hydrogen, any convenient conventional monovalent amino substituent group (e.g., a hydrocarbon or halohydrocarbon group), or a group that forms a five or six membered heterocyclic ring fused with the azine ring completed by Z.

3. A process according to claim 2 further characterized in that the 2-hydroaminoazine satisfies the formula:

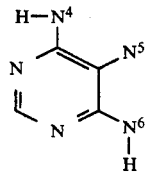

wherein:

$N^4$, $N^5$ and $N^6$ are independent amino moieties.

4. A process according to claim 3 further characterized in that the 2-hydroaminoazine satisfies the formula:

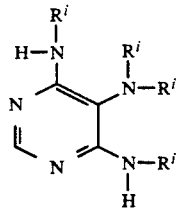

where $R^i$ is independently in each occurrence hydrogen or alkyl of from 1 to 7 carbon atoms.

5. A process according to claim 2 further characterized in that the 2-hydroaminoazine satisfies the formula:

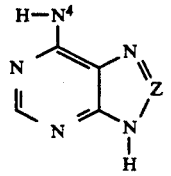

where $N^4$ is an amino moiety and

Z represents the atoms completing a 5 or 6 member ring.

6. A process according to claim 5 further characterized in that the 2-hydroaminoazine is adenine.

7. A process according to claim 1 further characterized in that the morphological stabilizer is a xanthinoid that satisfies the formula:

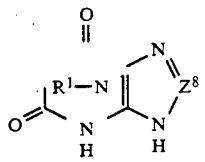

where $Z^8$ is $-C(R^8)=$ or $-N=$;

$R^8$ is H, $NH_2$ or $CH_3$; and $R^1$ is hydrogen or a hydrocarbon of from 1 to 7 carbon atoms.

8. A process according to claim 7 further characterized in that the xanthinoid morphological stabilizer satisfies the formula:

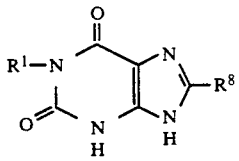

where $R^1$ is hydrogen or a hydrocarbon of from 1 to carbon atoms; and $R^8$ is H, $NH_2$ or $CH_3$.

9. A process according to claim 7 further characterized in that the xanthinoid morphological stabilizer satisfies the formula:

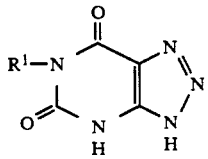

$R^1$ is hydrogen or a hydrocarbon of from 1 to 7 carbon atoms.

10. A process according to claim 1 further characterized in that a spectral sensitizing dye is present in the emulsion during chemical sensitization.

11. A process according to claim 10 further characterized in that the spectral sensitizing dye contains a divalent sulfur atom.

* * * * *